United States Patent [19]

Wallen et al.

[11] 4,051,799

[45] Oct. 4, 1977

[54] RADIAL DEPRESSOR

[75] Inventors: Albert E. Wallen, Winston Salem; Paul L. Whitehead, Burlington, both of N.C.

[73] Assignee: The United States of America as represented by the Secretary of the Navy, Washington, D.C.

[21] Appl. No.: 700,675

[22] Filed: June 28, 1976

[51] Int. Cl.[2] ..... B63B 21/00

[52] U.S. Cl. ..... 114/244; 114/16 R; 114/274

[58] Field of Search ..... 114/235 R, 235 B, 16 A, 114/16 R, 16 F, 16 E, 25, 66.5 H, 206 R; 9/8 R; 115/28 A, 6.1; 244/44

[56] References Cited

U.S. PATENT DOCUMENTS

| | | | |
|---|---|---|---|
| 2,368,059 | 1/1945 | White | 244/42 A |
| 2,727,485 | 12/1955 | Combs | 114/16 R |
| 3,056,373 | 10/1962 | Hawthorne et al. | 114/235 R |
| 3,136,501 | 6/1964 | Barber | 244/44 |
| 3,749,045 | 7/1973 | Angus | 114/235 B |
| 3,753,415 | 8/1973 | Burtis | 114/66.5 H X |

*Primary Examiner*—Trygve M. Blix
*Assistant Examiner*—Sherman D. Basinger
*Attorney, Agent, or Firm*—Richard S. Sciascia; Harvey A. David

[57] ABSTRACT

A depressing force in the form of negative lift is hydrodynamically generated on a towed underwater vehicle as a result of fluid in motion passing static fluid separated by a membrane so as to cause a negative pressure zone externally of the membrane. The external negative pressure enhances distension of the membrane into a water foil generating additional negative lift.

7 Claims, 2 Drawing Figures

RADIAL DEPRESSOR

BACKGROUND OF THE INVENTION

This invention relates to a towed submerged vehicle, and more particularly to the generation of forces acting on such vehicle in directions substantially normal to their direction of travel for purposes of depth and attitude control.

Heretofore, depth and attitude of submersible vehicles, notably those intended to be towed at predetermined depths for scientific or military purposes, has been achieved principally through the use of vanes, wings, canards and like control appendages. Such appendages are effective and can be varied in position, for example in response to water pressure, to maintian a selected depth in a towed vehicle. U.S. Pat. No. 3,749,045 to C. D. Angus, et al, presents good examples of such devices. Among the disadvantages inherent in the use of such control appendages are the notable size, weight, and cost factors, and in addition the very important factor of increased drag.

The factor of drag manifests itself in difficulties in keeping a high speed underwater towed vehicle at a desired water depth without placing exorbitant strains on the towing gear, as well as on towed device itself.

Vehicles having wings, diving planes, and the like are also prone to become unstable when operated at speeds for which turbulance and cavitation effects override designed lift or depressing forces. Moreover, control appendages increase likelihood of fouling on cables, underwater obstructions, and the like.

SUMMARY OF THE INVENTION

The present invention aims to overcome most or all of the foregoing disadvantages or shortcomings of the prior art thorugh the combination with an underwater or submersible towed vehicle of one or more distensible areas of hull surface in such a manner as to produce predetermined zones of low pressure adjacent the towed body when moving through water, such that the resultant of forces acting radially around the hull will reduce the coefficient of drag and will provide a depressant force on the towed body tending to prevent the vehicle from deviating from a desired depth.

With the foregoing in mind, it is a principal object of the invention to provide an improved underwater towed vehicle control system.

Another object of the invention is the provision of an underwater vehicle adapted to be towed at predetermined depths, for example to carry scientific or military instrumentation, and which vehicle comprises novel constructions responsive to ambient pressures and rate of flow through water medium to produce vehicle depressing forces that counteract tendencies of the vehicle to rise or surface as vehicle speeds increase.

As another object the invention aims to provide an underwater vehicle of the foregoing character wherein drag forces are lessened concommittently with the generation of depressing forces.

Still another object is to accomplish the foregoing without the use of wings or vanes, fins, or other rudder-like control surfaces or diving planes, thereby further minimizing drag and avoiding the complex internal mechanisms necessary for their operation.

Yet another important object is the provision of an improved, towable underwater body or vehicle that exhibits unusual stability together with a capability of being towed at substantial depths, using less faired tow cable for a given depth compared with conventional towed bodies.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
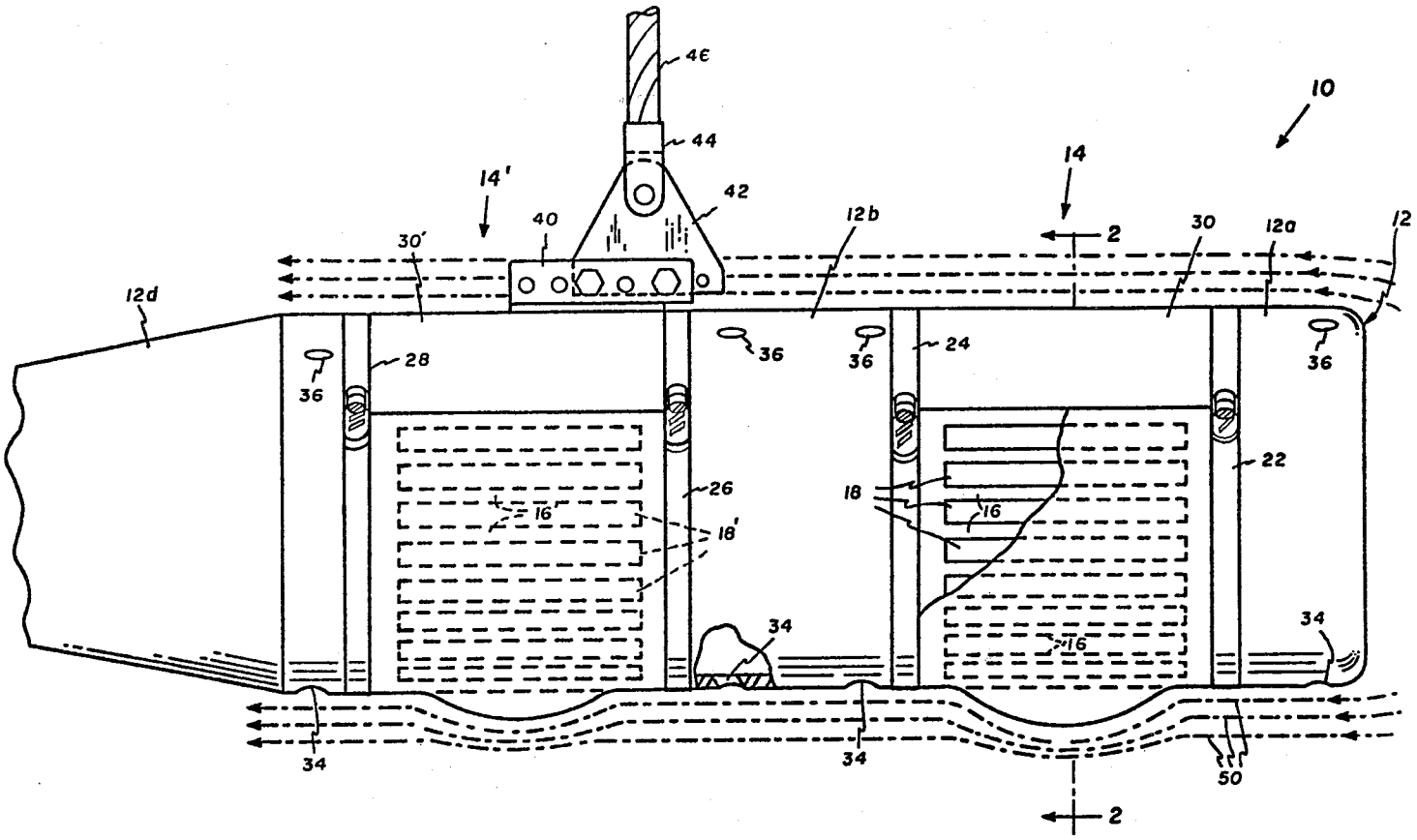
FIG. 1 is a fragmentary side elevational view of a towable underwater vehicle embodying the invention, with portions broken away to reveal inner structure.
Figure 2:
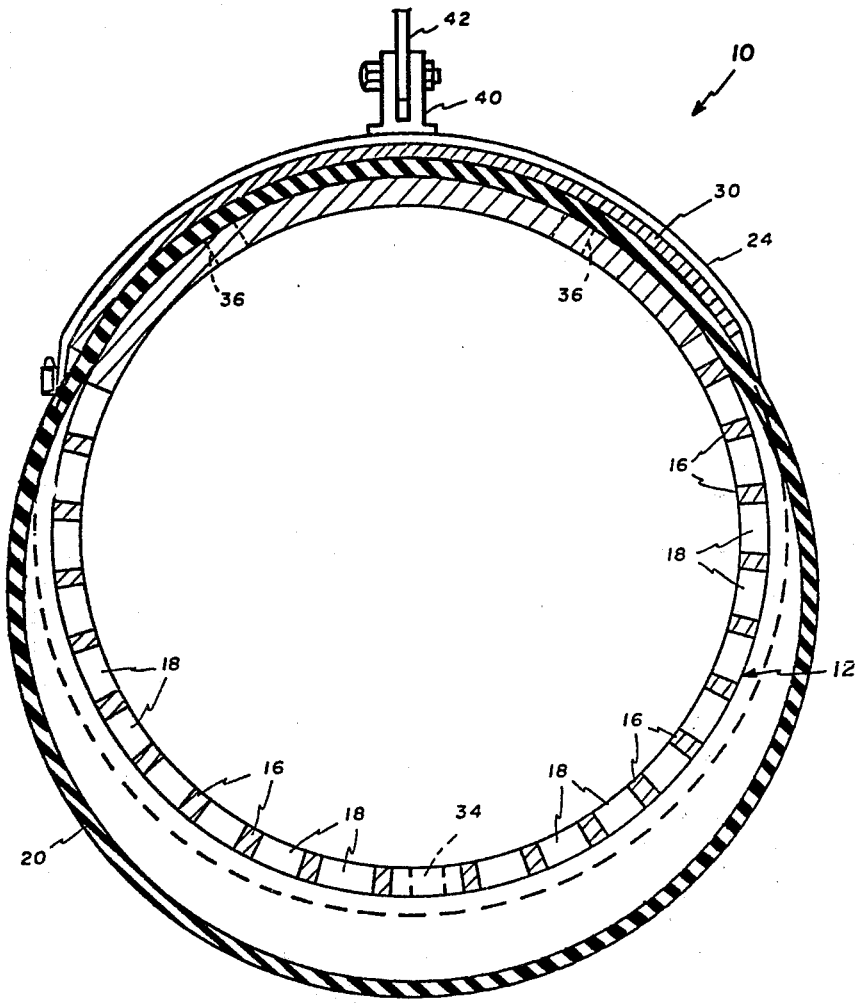
FIG. 2 is a sectional view, on an enlarged scale, taken substantially along line 2—2 of FIG. 1.

In the form of the invention illustrated in the drawings and described hereinafter, there is provided a towable vehicle, generally indicated at 10 in FIG. 1 and comprising a rigid body or hull 12 having cylindrical nose, mid, and rear sections 12*a*, 12*b*, and 12*c*, respectively. A tapered or conical tail section 12*d* may be included for streamlining purposes and may or may not carry stabilizer fins, not shown.

Disposed between the nose section 12*a* and the mid section 12*b* of hull 12 is a control section, generally designated at 14. A second control section, generally designed at 14', is disposed between the mid section 12*b* and the rear section 12*c.* The control sections 14 and 14' serve to produce downward or depressing forces on the towed vehicle 10 in a manner which will be made apparent as this specification proceeds. Suffice it to say for the moment that the depressing force is the resultant of radially imposed forces. Accordingly, in the embodiment being described, the sections 14 and 14' may be referred to as radial depressors.

Cylindrical hull sections 12*a* and 12*b* are joined by a plurality of spaced, parallel bars 16, between which are defined a plurality of elongated openings of slots communicating between the exterior and the interior of the hull 12. Similarly, the cylindrical hull sections 12*b* and 12*c* are joined by a plurality of spaced, parallel bars 16', between which are defined a plurality of elongated openings or slots 18' extending from the exterior of the hull to the interior thereof. These bars 16, 16' and slots 18, 18' alternate around the circumference of the hull and form cylindrical grids within which may be disposed scientific or military payload or instrumentation, for example electroacoustic transducers. The particular instrumentation or payload of the vehicle 10 is notgermain to the invention per se and so is neither shown nor described further.

Surrounding the grids defined by bars 16, 16' and slots 18, 18' are cylindrical membranes 20, 20' of thin, flexible and waterproof, rubber or other preferably elastomeric sheet material. The cylindrical membranes 20, 20' have their end portions clamped to the nose, mid, and rear sections of the hull. Thus, membrane 20 is secured at its forward end to nose section 12*a* by a band clamp 22 and its rearward end to mid section 12*b* by a band clamp 24. Membrane 20' is secured at its forward end to mid section 12*b* by a band clamp 26 and at its rearward end to the rear section 12*c* be a band clamp 28. In accordance with the invention, and as will later be explained further, the cylindrical membranes 20, 20' are adapted to distend or baloon out, in response to a negative pressure external to the membranes due to external fluid motion relative to internal static fluid in such a manner as to create a negative lift or depressing force.

Also secured to the hull 12, as by clamps 22, 24, 26, and 28, and forming part of the radial depressor sections 14 and 14', respectively, are a pair of cylindrically curved, force direction plates 30 and 30'. The plates 30 and 30', which in this example encompass about one third of the vehicle circumference, prevent the membranes 20 and 20' from distending in the upper regions of the hull.

A plurality of water inlet ports or scoops 34 are positioned along the lower regions of the hull 12, while a plurality of openings or vents 36 are provided in the upper regions thereof. The scoops 34 and vents 36 permit the hull 12 to be free flooding upon immersion in a water medium. Moreover, the scoops 34, which are conveniently in the form of an opening that penetrates the hull wall obliquely, are arranged to prevent the reduction of internal pressure due to water passing over openings in the tow body. The scoop action counterbalances the pressure loss effect at the vent openings restoring a hydrostatic state of substantial equilibrium.

Conveniently fixed to plate 30' is a bracket 40 which is adapted to receive a triangular plate 42. The plate 42 is provided with a series of holes that can be aligned with selected ones of a series of holes in bracket 40 and bolted, as shown. This permits a towing and support point that is readily adjustable fore and aft of the vehicle 10. Plate 42 has an eye that is engaged by the pin of a clevis member 44 fixed to the end of a tow cable 46 which, of course, may also include suitable electrical conductors for connection to whatever instrumentation may be carried by the vehicle 10. It has been found that the vehicle 10 functions well when plate 42 is adjusted relative to bracket 40 so that the vehicle balances substantially horizontally when suspended in air by the cable 46.

In operation, the vehicle 10 is lowered into the water and allowed to flood by virtue of the scoops 34 and vents 36. The membranes 20, 20' will be in a collapsed or non-distended condition at that time. Thereafter, towing of the vehicle through the water causes the membranes 20, 20' to distend, due in part to any slight elevation in internal pressure that may result from the impact of water entereing the scoops 34 to counteract the pressure loss effect of water passing over holes used to flood the towed body, and in part due to the mentioned negative pressure resulting from fluid flow over the membranes. Distension of the membranes 20, 20' is maximum at the bottom of the towed vehicle, 180° from the centers of the force direction 30, 30'. Fluid in motion, represented by flow lines 50, passing over static fluid separated therefrom by a flexible membrane will cause the membrane to distend depending on the velocity difference between the distended area and the non-distended area. The resultant negative lift, based on Bernoulli's principle, is further enhanced as the membranes expand, thus increasing the fluid velocity.

Because of the negative lift just described, the vehicle, when towed, tends to sound and accordingly runs at a substantially greater depth for a given length of tow cable 46 than would be the case without the action of the depressor sections 14, 14' of this invention.

Obviously, other embodiments and modifications of the subject invention will readily come to the mind of one skilled in the art having the benefit of teachings presented in the forgoing description and the drawing. It is, therefore, to be understood that this invention is not to be limited thereto and that said modifications and embodiments are intended to be included within the scope of the appended claims.

What is claimed is:

1. A vehicle adapted to be towed in a submerged state through a body of water and to generate vehicle depressing forces as a result of apparent flow of water relative to the exterior of said vehicle, said vehicle comprising:

an elongated hull having rigid walls defining an interior cavity, said walls being characterized by openings communicating between said cavity and the exterior of said walls;

means for flooding said cavity with water that is substantially static relative to said vehicle;

distensible membrane means disposed at predetermined areas of said walls and overlying said openings so as to separate said static water in said cavity from said flow of water relative to said vehicle and responsive thereto to distend into a negative pressure zone enhancing waterfoil; and said membrane means having its maximum distension confined to the lower regions of said hull, whereby the resultant of radial forces acting radially about said hull is a depressing force urging said vehicle to sound.

2. A vehicle as defined in claim 1, and wherein:

said hull is substantially cylindrical and said walls comprises a radial depressor section, characterized by a plurality of said openings therethrough, between two substantially imperforate sections; and said membrane is substantially cylindrical and ensleeves said radial depressor section so as to overlie said plurality of openings, and is fixed at opposite ends to said substantially imperforate sections.

3. A vehicle as defined in claim 2 and wherein:

said means for flooding said cavity comprises a plurality of inlet ports in the lower portions of said hull and a plurality of vents in the upper portions of said hull.

4. A vehicle as defined in claim 3, and wherein:

said inlet ports penetrate said hull obliquely so as to serve as scoops during towing of said vehicle, whereby pressure in said cavity is maintained at least substantially equal to ambient pressures.

5. A vehicle adapted to be towed underwater by cable, said vehicle comprising:

an elongated hull comprising cylindrical nose, mid, and aft sections, a first radial depressor section disposed between said nose and mid sections, and a second radial depressor section disposed between said mid and aft sections;

said first and second radial depressor sections each comprising hull walls characterized by a plurality of openings at least in the lower regions of the circumference thereof, and an elastomeric, distensible membrane disposed on the outer side said hull walls in overlying relation to said openings and having its edge portions fixed in watertight relation to said hull;

water intake ports, defined in said hull and communicating with said openings so as to admit substantially static water between said hull walls and each membrane of said radial depressor sections, whereby said membranes distend and present curved waterfoil surfaces in the lower regions of said depressor sections so that negative lift is effected on said depressor sections and said vehicle will sound to a towing depth limited by the length of said cable.

6. A vehicle as defined in claim 5, and wherein:

said hull walls of said depressor sections are characterized by a plurality of parallel bars and slots extending between said nose and mid sections and between said mid and aft sections; said membranes are each substantially cylindrical and ensleeve said walls of said depressor sections; and said depressor sections each further comprises a curved plate overlying the upper regions of said membranes so as to confine distension of said membranes to less than about two thirds of the circumference of the respective depressor sections.

7. A vehicle as defined in claim 6, and wherein said hull is provided with vent means in the upper portions thereof and said intake ports comprises scoop means disposed on the lower regions of said hull and oriented to scoop in the direction of vehicle forward movement.

* * * * *